US005605304A

United States Patent [19]

Ahern, Jr.

[11] Patent Number: 5,605,304

[45] Date of Patent: Feb. 25, 1997

[54] PAPER TOWEL DISPENSER

[75] Inventor: Richard B. Ahern, Jr., Akron, Ohio

[73] Assignee: Rubbermaid Incorporated, Wooster, Ohio

[21] Appl. No.: 498,671

[22] Filed: Jul. 3, 1995

[51] Int. Cl.[6] ..... B65H 75/02

[52] U.S. Cl. ..... 242/588; 242/596.3

[58] Field of Search ..... 242/588, 588.2, 242/596, 596.1, 596.3, 596.7, 596.8; D6/518, 522, 523

[56] References Cited

U.S. PATENT DOCUMENTS

| | | | |
|---|---|---|---|
| D. 326,580 | 6/1992 | Brazis | D6/522 |
| D. 359,657 | 6/1995 | Davidson et al. | D7/622 |
| 1,513,850 | 11/1924 | Morton | 242/588 |
| 2,879,012 | 3/1959 | Sarro | 242/596.3 |
| 3,799,466 | 3/1974 | Adams | 242/596.3 |
| 4,535,948 | 8/1985 | Gillen | 242/596.3 |
| 4,553,710 | 11/1985 | Pool . | |

FOREIGN PATENT DOCUMENTS

| | | | |
|---|---|---|---|
| 517706 | 10/1955 | Canada | 242/596 |

OTHER PUBLICATIONS

P. 2, Paper towel holder; M. Kamenstein, 190 East Post Road, White Plains, New York 10601. Published at least as early as May, 1994.

Catalog page, Paper towel holder; Guzzini, Fratelli, Guzzini Spa, cdo Mattonata, 60, 62019 Recanati–Italy. Publication date Jan., 1992.

Catalog page, Paper towel holder; Rubbermaid Incorporated, 1147 Akron road, Wooster, Ohio 44691. Publication date 1991.

*Primary Examiner*—John P. Darling

*Attorney, Agent, or Firm*—Richard B. O'Planick; Lisa B. Riedesel

[57] ABSTRACT

A unitarily molded towel dispenser (10) comprising an arcuate arm member (12), a cap member (14) connected to a top end of the arm member, and a platform (16) connected to a bottom end of the arm member. Opposed surfaces (42, 48) are spaced apart to receive a paper roll therebetween, and include pivot lugs (46, 48) that project into the core of the paper roll so as to enable the roll to rotate thereabout. The cap member (14) is resiliently spread apart from the platform member (16), straightening the arm member (12), and creating clearance space for the roll to be laterally inserted. Thereafter, the cap member (14) is released and, under the influence of the arm member, moves toward the platform member (16) and into a quiescent spacing therefrom. The arm member (12) functions as a carry handle and as a spring member with which to influence the cap member (14) toward the platform member (16) and entrap the paper roll therebetween.

12 Claims, 5 Drawing Sheets

PAPER TOWEL DISPENSER

BACKGROUND OF THE INVENTION

1. Field of the Invention

The subject invention relates generally to holders for rolled sheet products and, specifically, to holders for retaining and dispensing a paper towel roll.

2. The Prior Art

Paper towel dispensers are well know consumer products. Typically such dispensers are wall mounted and comprise a back panel and spaced apart arms extending outward from opposite ends of the back panel. The arms of different dispensers accommodate receipt of paper towels in roll form therebetween in a different ways. One commercial dispenser, sold as Rubbermaid Incorporated product No. 2361-87 has arms that pivot outward to receive a towel roll, and then pivot inward to capture the roll. Ends of the arms have lugs that fit into the core of the towel roll, providing pivot pins about which the roll can rotate.

Another approach, represented by Rubbermaid product No. 2364, teaches the incorporation of spring biased lugs mounted into the ends of the dispenser arms. The lugs recess inwardly as the towel roll is inserted thereagainst and, when the roll is at its final position, the lugs eject outward and into the roll core. The roll can then rotate about the lugs as individual sheets of paper are withdrawn.

While the above dispensers work well and have been well accepted, several shortcomings prevent them from meeting all of the needs of consumers. First, such dispensers are at a fixed location in their intended use and cannot be conveniently transported to alternate work sites where paper towels are needed. The fixed mounting of conventional dispensers to cabinet doors or walls, thus, is inconvenient when the task is remotely located.

Secondly, conventional dispensers are comprised of multiple parts, requiring some assembly. As such, the dispensers are relatively more expensive and cumbersome to manufacture and cost more to the consumer.

SUMMARY OF THE INVENTION

The subject invention overcomes the above described shortcomings in conventional towel dispensers by providing an integrally molded dispenser comprising a C-shaped arcuate arm member, an upper cap member connected to an upper arm of the arm member, and a lower base member connected to a lower end of the arm member. The unit is freestanding and is also transportable by manually grasping the arm member.

The cap and base members provide opposed spaced apart surfaces from which pivot lugs project. The spacing between the opposed surfaces is, in the quiescent state, is the nominal standard length of a roll of paper towels. In order to admit the roll between the opposed surfaces and past the pivot lugs, the arm member elongates by manually spreading the cap member from the base member, causing the cap member to separate an additional distance from the base member. The towel roll can thence be laterally inserted between the opposed surfaces. The arm member is adapted to have a strengthening flange formed along an inward surface to add the requisite rigidity and flexure to the member.

When the roll is in proper position, the cap member is released and the arm member resiliently draws the cap member back into its quiescent spacing from the base member. As the cap member returns to its initial relative orientation, its pivot lug enters into the towel roll core and the towel roll can rotate as individual sheets are withdrawn.

Thus, the subject dispenser can function as a freestanding dispenser of paper towels and can also be readily transported from work site to work site. The dispenser is of unitary construction, requiring no assembly and no assembly hardware.

Accordingly, it is an objective of the subject invention to provide a towel dispenser of unitary construction requiring no assembly and no assembly hardware.

Another objective is to provide a towel dispenser that is freestanding and, alternatively, conveniently relocatable to remote work areas if so desired.

Yet another objective is to provide a towel dispenser that has an integral handle.

Still another objective is to provide a towel dispenser that is adjustable to accommodate lateral insertion of rolled paper therein.

A further objective is to provide a towel dispenser having a rigidity adjustment means for controlling the degree of flexibility of the handle arm member.

Yet a further objective is to provide a towel dispenser that is economically and readily manufactured and used.

These and other objectives, which will be apparent to those skilled in the arts, are achieved by a preferred embodiment that is described in detail below and illustrated in the accompanying drawings.

BRIEF DESCRIPTION OF THE ACCOMPANYING DRAWINGS

DESCRIPTION OF THE PREFERRED EMBODIMENT

Figure 1:
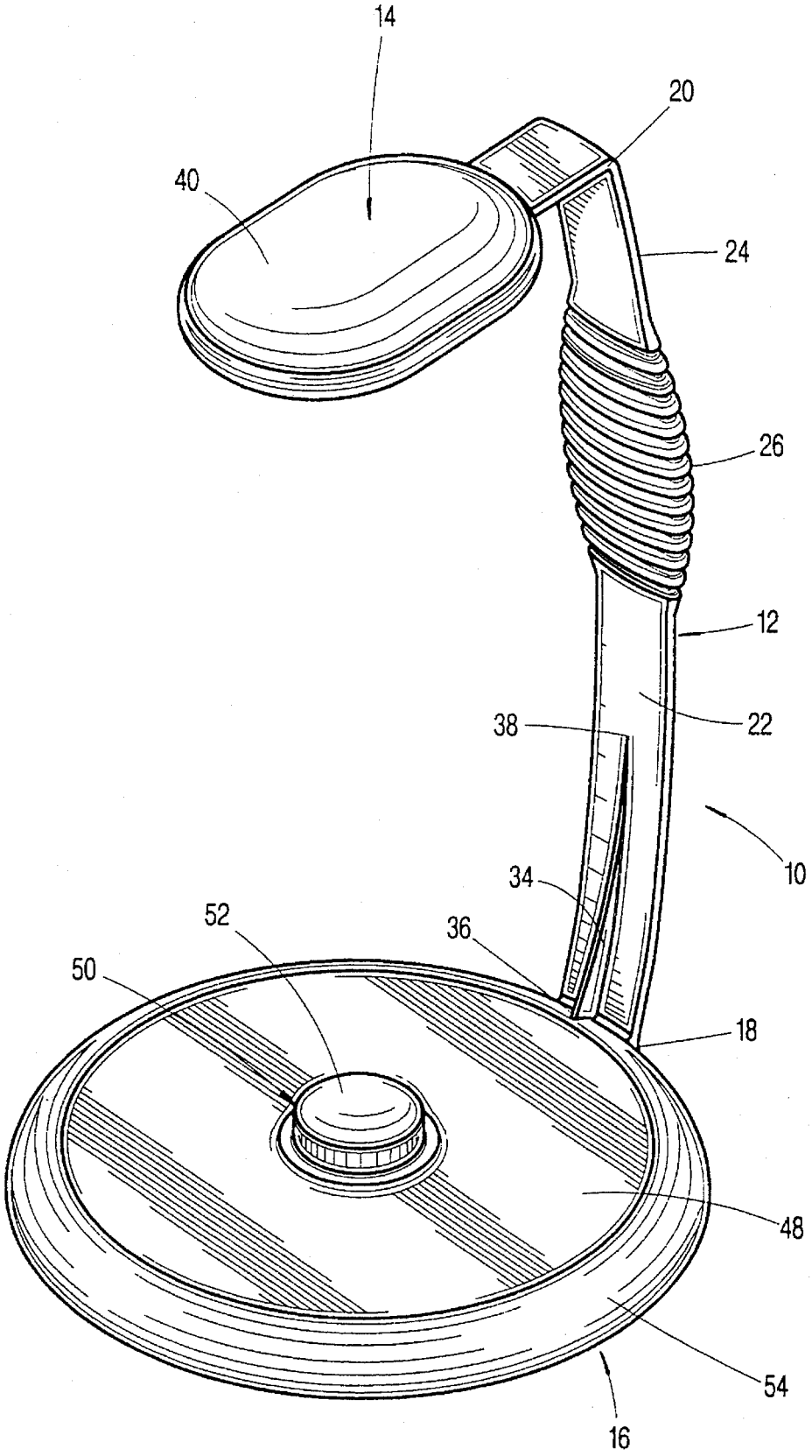
FIG. 1 is a perspective view of the subject dispenser in the freestanding orientation.

Referring initially to FIG. 1, the subject dispenser 10 is a unitarily molded plastic body, formed by conventional molding techniques such as injection molding of conventional plastic such as polypropylene. The dispenser 10 thus requires no assembly and no assembly hardware, making it economical to manufacture and sale at a relatively low price.

The dispenser 10 is of generally a C-shape profile and comprises an arcuate arm member 12, an oblong, relatively small cap member 14, and a circular, relatively large base or platform 16. The aforementioned components are unitarily molded together and are of the same material, preferably polypropylene plastic.

Figure 3:
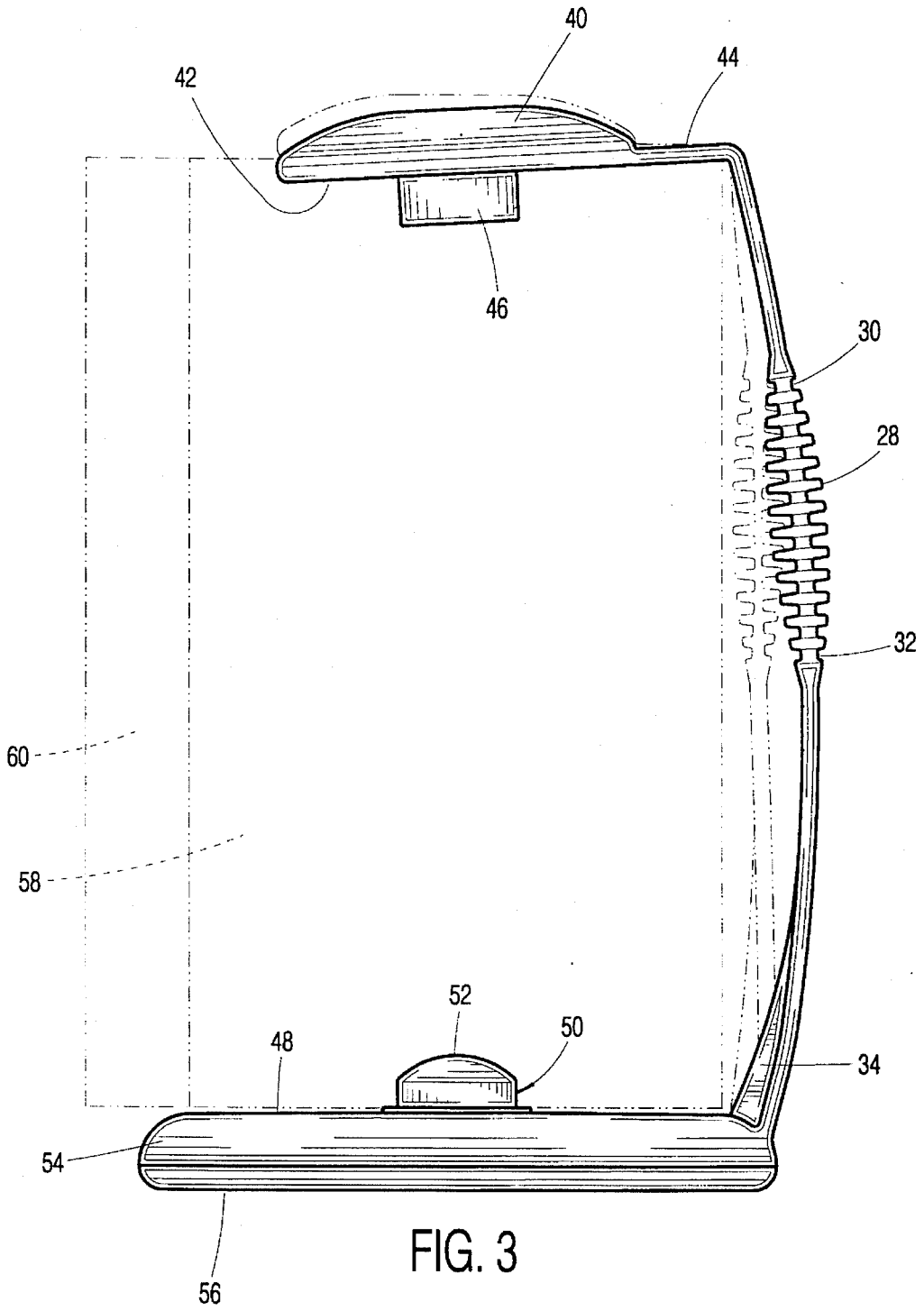
FIG. 3 is a side elevational view thereof.
Figure 4:
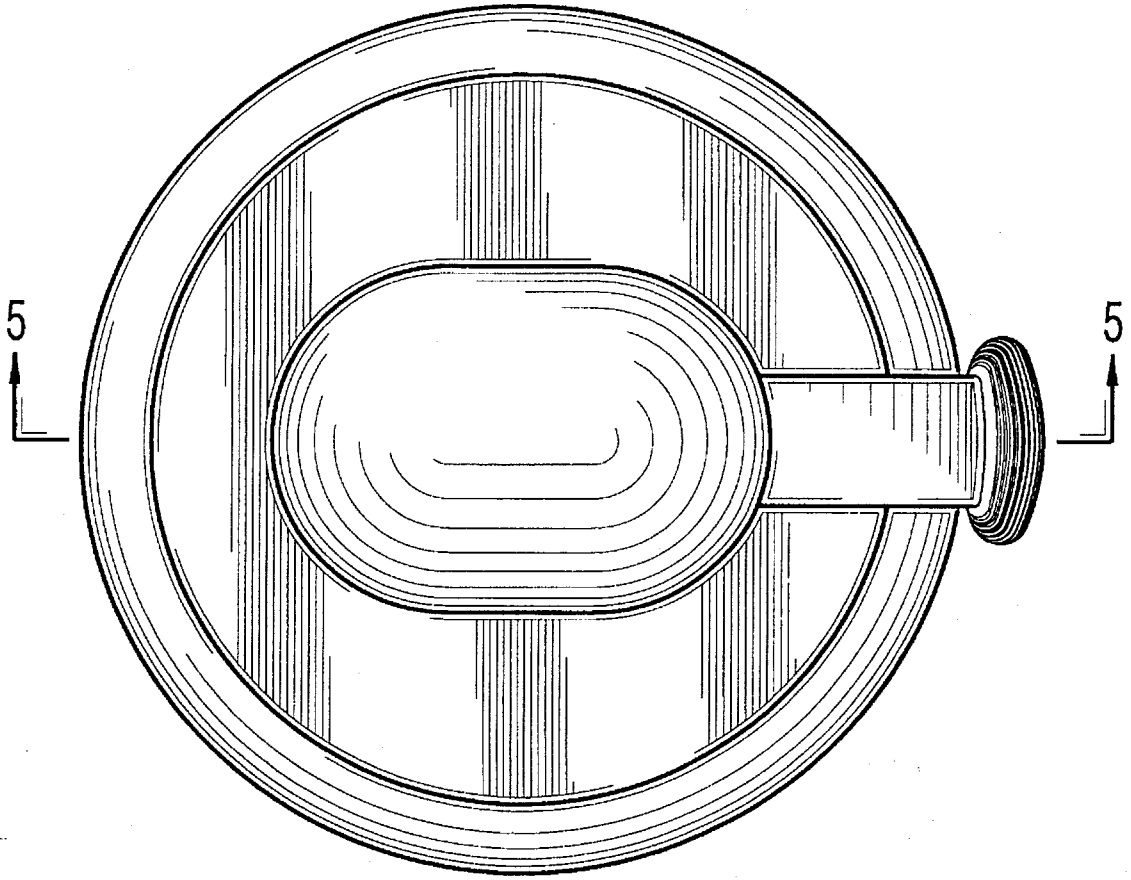
FIG. 4 is a top plan view thereof.
Figure 5:
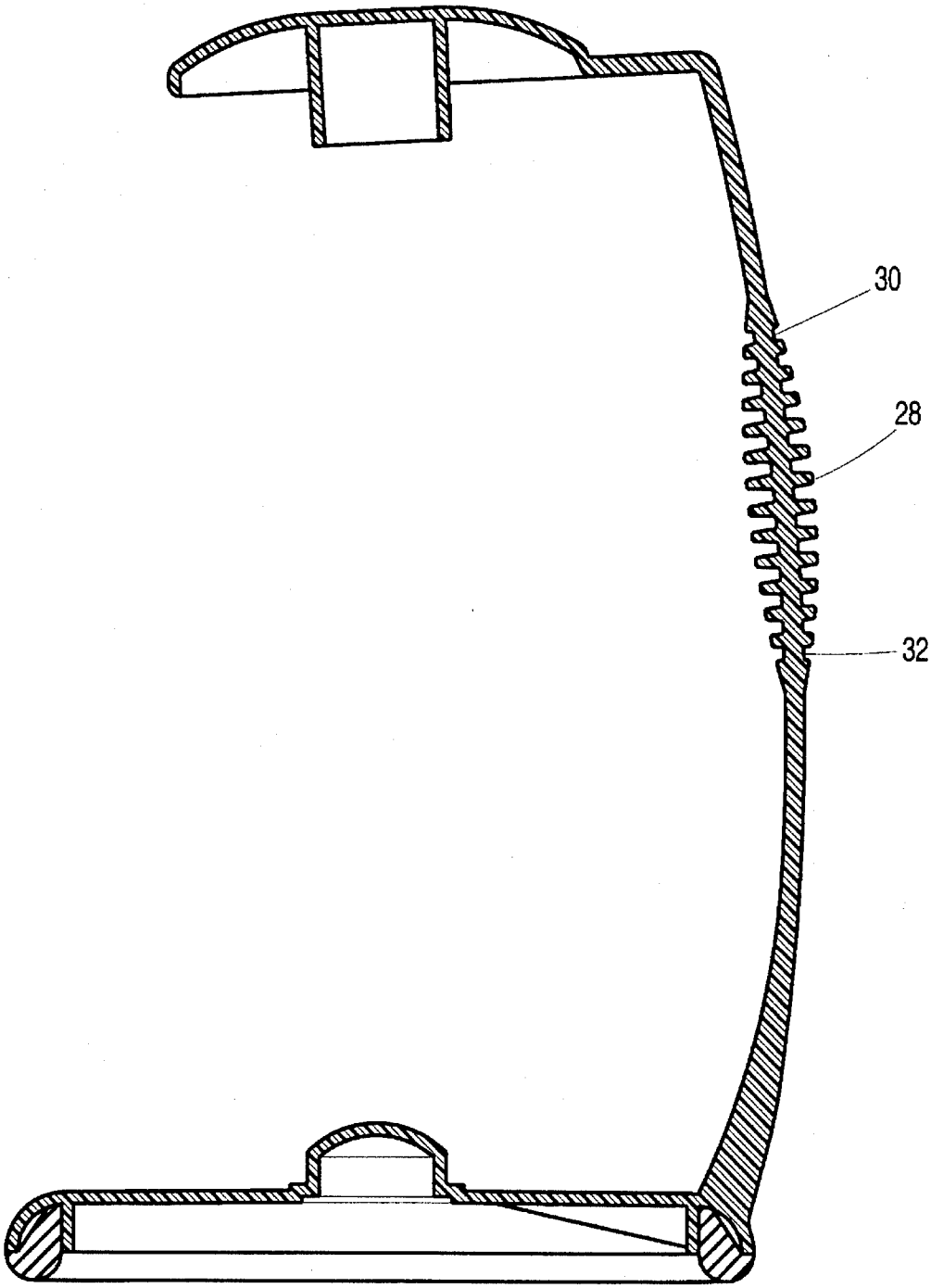
FIG. 5 is a longitudinal section view thereof taken along the line 5—5 of FIG. 4.

Continuing, the arm member 12 has a lower end 18 and an upper end 26 and is generally configured as a concave strip. The arm 12 has a smooth inner surface 22 and a smooth, outward facing surface 24. Disposed approximately one-third of the distance from the upper end 20 to the lower end 18 is an enlarged, molded handle portion 26 as best seen by FIGS. 3 and 5. With reference thereto, it will be seen that the handle portion comprises a series of circumferential, spaced- apart ribs 28 extending along a region bounded by an upper end 30 and a lower end 32. The ribs increase in height from each end 30,32 to a maximum height that occurs in a rib located midpoint between ends 30,32.

With reference to FIGS. 1, 3, and 5, an arcuate, triangular shaped reinforcement flange 34 is formed to extend along a lower portion of inner arm surface 22, and flange 34 decreases in height from a lower end 36 to an upper end 38. The relative size of the flange 34 will be appreciated from the referenced drawings and its purpose will be understood from the explanation provided below.

The cap member 14 is oblong in shape, having radiussed corners and a slightly domed upper surface 40. A substantially horizontal downward facing surface 42 is provided at the underside of the cap member 14 and a connective strip 44 connects the cap member 14 to the upper end 20 of the arm member 12. The strip 44 is of the same dimension and sectional configuration as the arm member 12. A pivot lug 46 of cylindrical configuration is formed to depend from the middle of the surface 42.

The platform member 16 is freestanding, comprising a planar top surface 48 of circular configuration. A pivot lug 50 projects upward from the center of the surface 48, and is generally cylindrical at the sides and domed at a top surface 52. The lug 50 is aligned below the lug 46 of the cap member 14.

The platform member surface 48 merges at its peripheral edges with a downturned skirt 54 that proceeds downward to a bottom, planar surface 56. The surface 56 is intended to support the dispenser in the upright condition shown. As seen in FIGS. 1, 3, and 5, the lower end 18 of the arm member 12 is integrally formed to intersect the periphery of the top surface 48 of the platform member 16. In the unloaded, quiescent condition depicted in FIG. 3 the cap member 14 projects from the upper end of arm member 12 slightly below horizontal, preferably to the order of three (3) degrees. The lugs 46 and 50 are vertically aligned and spaced apart a distance slightly less than the nominal standardized length of a roll of paper towels, preferably on the order of eleven (11) inches.

Figure 2:
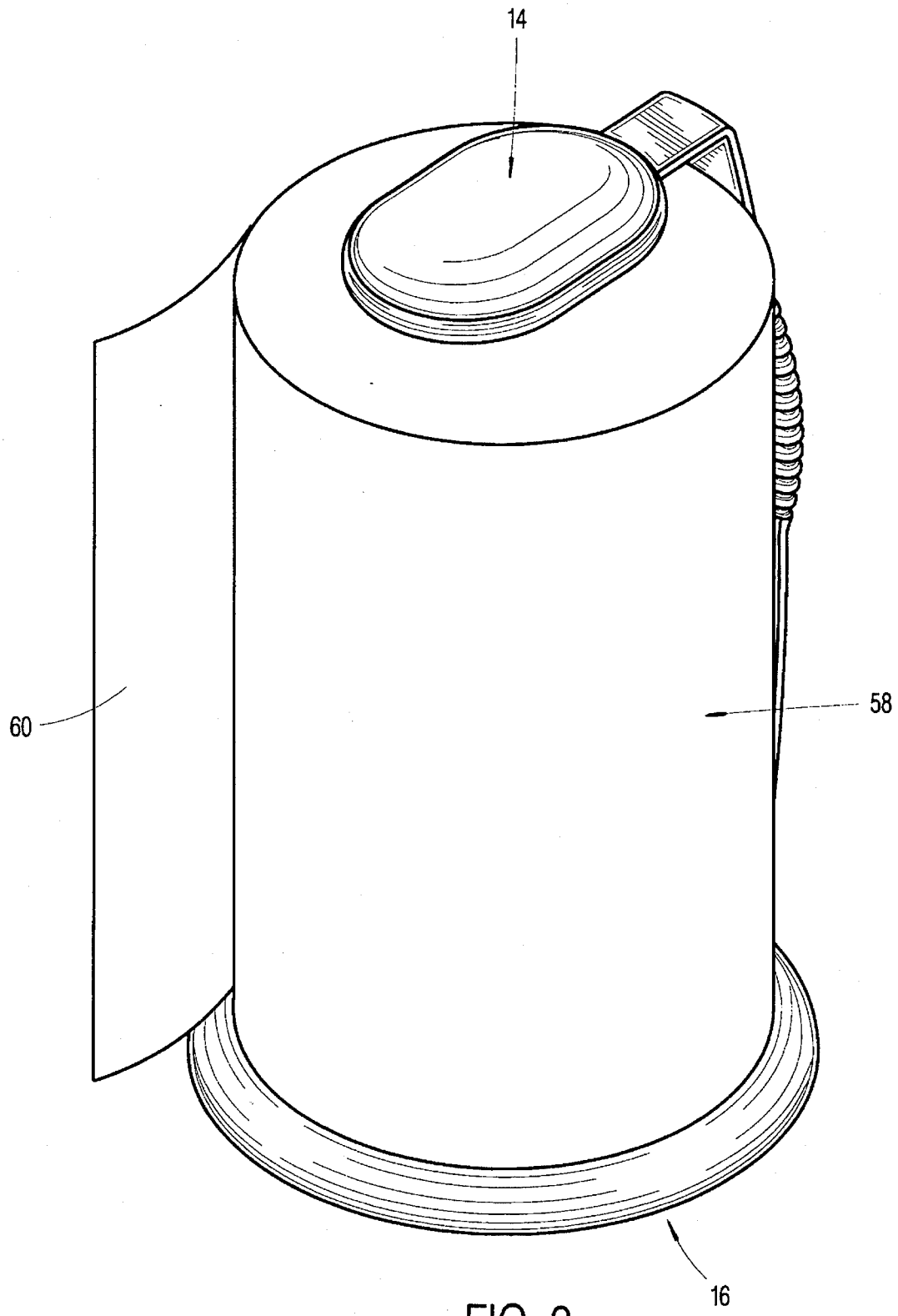
FIG. 2 is a perspective view thereof with a roll of paper towels in place.

As best seen from FIGS. 2 and 3, a towel roll 58 having a free edge 60 is laterally inserted between the surfaces 42 and 48 as follows. In order to allow sufficient clearance for the roll 58 to clear lugs 46, 50, the cap member 14 is manually flexed away from the platform member 16, thereby increasing the distance therebetween. The movement of cap member 14 is shown in FIG. 3 in phantom. It will be appreciated that as the cap member 14 is moved upward, the arm member 12 straightens against its curvature.

The increase in distance between retaining surfaces 42, 48 that results is sufficient to permit lateral insertion of the roll 58 between the opposed surfaces 42, 48, clearing pivot lugs 46, 50. When the core of the roll 58 is aligned between the lugs 46, 50, the cap member 14 is released and, under spring bias of the arm member 12, moves downward and resumes its equiescent spacing from the platform member 16. The pivot lugs 46, 50 enter into opposite ends of the hollow core of the roll 58 (not shown), and therein represent a pivot axis about which the roll 58 rotates.

It will be appreciated that the retaining surface 42 of the cap member 14 is disposed adjacent and pressured by arm member 12 against the top surface of the roll 58 and the bottom surface of the roll 58 rests upon the surface 48. Thus, the roll 58 is free to rotate about the lugs 46, 50 yet is restrained by the lugs and the pressure exerted by surface 42 from leaving its position between the members 14, 16. The free end 60 of the roll 58 can be digitally pulled to rotate the roll 58 and thereby extract a desired length of paper in conventional fashion.

The arm member 12 is arcuate in side profile and serves in several capacities. First, as seen by FIG. 3, the arcuate shape of the arm member 12 creates a space between the roll 58 wherein a user can insert fingers and manually grasp the handle portion 28. Secondarily, the arm member 12 acts as a retention spring for drawing the cap member downward toward the platform member 16 and thereby entrapping the roll 58. Movement of the cap member 14 upward will straighten the arm member 12, and build up a spring force within the arm member that, upon release of the cap member 14, will draw the arm member 12 back into its arcuate configuration and the cap member downward. The movement of the cap member and the arm member between the quiescent and flexed conditions is depicted in phantom in FIG. 3.

The strengthening flange 34 along the lower portion of the arm member 12 serves to stiffen the arm member to the correct extent. The arm member 12 must be stiff enough to spring back into its arcuate configuration to trap the towel roll yet be sufficiently flexible to allow the cap member 14 to be manually spread apart from the platform member 16. The flange 34 is preferably two and eight-tenths (2.8) inches long, relative to an arm member having a length of eleven and five-tenths (11.5) inches. It has been found that a flange of such configuration and length creates an arm member having an optimal stiffness for the intended purpose.

From the foregoing, the subject invention is seen to provide an inexpensive to manufacture plastic product of unitary construction, having no assembly hardware and requiring no assembly. The dispenser can function in a freestanding orientation to dispense towels and can further be conveniently transported to alternative work sites by use of the arm member 12. Additionally, the subject dispenser can find applications in dispensing other types of rolled goods if so desired.

While the above describes the preferred embodiment of the subject invention, the invention is not intended to be so limited. Other embodiments, that will be apparent to those skilled in the art, and which utilize the teachings herein set forth, are intended to be within the scope and spirit of the invention.

I claim:

1. A dispenser for a roll of sheet material, comprising:

an integral, substantially C-shaped body having an elongate arcuate shaped arm member, a substantially horizontal platform portion connected to a lower end of the arm member, and a substantially horizontal upper retaining cap member connected to an upper end of the arm member, the cap member and the platform portion having opposed, spaced apart retaining surfaces adapted to receive and retain a roll of sheet material therebetween, and the arm member non-frangibly and temporarily distoring from a queiscent configuration into a flexed configuration to increase the spacing between the opposed retaining surfaces, whereby facilitating insertion of the roll of sheet material therebetween, and thereafter resuming the quiescent configuration to decrease the spacing between the retaining surfaces, whereby capturing the roll between the retaining surfaces; and a midsection of the arm member is sufficiently spaced from the captured roll to permit a digital grasp thereof, whereby enabling the dispenser to be carried by a user; and the arm member having a flexure controlling reinforcement flange projecting outward from an inward facing arm surface, the flange extend along the inward arm surface upwardly from the platform portion.

2. A dispenser according to claim 1, wherein the reinforcement flange decreasing in height from a lower end to an upper end.

3. A dispenser according to claim 2, wherein at least one of the opposed retaining surfaces having a centrally disposed pivot axis protuberance for projecting into a hollow end of the roll of towels, the roll rotating about the protuberance between the retaining surfaces.

4. A dispenser according to claim 3, wherein the dispenser is freestanding, supported by the platform portion.

5. A dispenser according to claim 4, wherein the retaining cap member is connected to the upper end of the arm member by an elongate strip having the same cross-sectional configuration and dimension as that of the arm member.

6. A dispenser for a roll of sheet material comprising:

an integral body having an elongate carrying handle member, a freestanding support platform connected to a lower end of the arm member and extending substantially perpenducularly therefrom, the platform supporting the handle member in a vertical orientation, and a cap member connected to an upper end of the arm member and extending substantially perpendicularly therefrom, and the cap member and the platform portion have opposed, spaced apart retaining surfaces adapted to receive and retain the roll of sheet material therebetween; and the handle member has a gripping midsection portion of larger relative width dimension.

7. A dispenser according to claim 6, wherein the handle member is arcuate in side profile, and the body having substantially a C-shape in side profile.

8. A dispenser according to claim 7, wherein the opposed retaining surfaces having engagement means for rotationally holding the roll of paper towels, whereby enabling the roll to rotate about a central axis.

9. A dispenser according to claim 8, wherein the engagement means comprising at least one protuberance projecting into a hollow end of the roll and acting therein as a pin about which the roll rotates.

10. A dispenser according to claim 9, wherein the handle member non-frangibly and temporarily distorting from a quiescent configuration into a flexed configuration to increase the spacing between the opposed retaining surfaces, whereby enabling a lateral insertion of the roll therebetween, and thereafter resuming the quiescent configuration to decrease the spacing between the retaining surfaces.

11. A dispenser according to claim 10, wherein the handle member having a flexure controlling reinforcement flange projecting outward from an inward facing handle member surface, the flange extending along the inward handle member surface upwardly from the platform portion.

12. A dispenser according to claim 11, wherein the reinforcement flange decreasing in height from a lower end to an upper end.

* * * * *

UNITED STATES PATENT AND TRADEMARK OFFICE

CERTIFICATE OF CORRECTION

PATENT NO. : 5,605,304

DATED : February 25, 1997

INVENTOR(S) : Richard B. Ahern, Jr.

It is certified that error appears in the above-indentified patent and that said Letters Patent is hereby corrected as shown below:

Column 2, Line 59, "26" should read --20--.

Column 4, Line 56, "distoring" should read "distorting".

Signed and Sealed this

Twentieth Day of May, 1997

*Attest:*

*Attesting Officer*

BRUCE LEHMAN

*Commissioner of Patents and Trademarks*